US005725459A

United States Patent [19]

Rexach

[11] Patent Number: 5,725,459

[45] Date of Patent: Mar. 10, 1998

[54] EXERCISE APPARATUS PROVIDING SIMULATED FREE WEIGHT EXERCISES AND COMPACT STOWAGE

[76] Inventor: Marco L. Rexach, 4th St. No. H6—Mansions of Garden Hills, Guaynabo, Puerto Rico, 00966

[21] Appl. No.: 642,539

[22] Filed: May 3, 1996

[51] Int. Cl.[6] ..... A63B 21/06

[52] U.S. Cl. ..... 482/92; 482/102; 482/103

[58] Field of Search ..... 482/94, 97–103, 482/112, 130, 135–138, 142, 908

[56] References Cited

U.S. PATENT DOCUMENTS

| | | | |
|---|---|---|---|
| 1,646,818 | 10/1927 | Holland . | |
| 1,745,435 | 2/1930 | Mensendieck . | |
| 2,632,645 | 3/1953 | Barkschat . | |
| 2,977,120 | 3/1961 | Morris . | |
| 4,109,907 | 8/1978 | Zito . | |
| 4,149,713 | 4/1979 | McLeod . | |
| 4,229,002 | 10/1980 | Masters . | |
| 4,603,855 | 8/1986 | Sebelle . | |
| 4,634,118 | 1/1987 | Jensen . | |
| 4,721,303 | 1/1988 | Fitzpatrick | 482/103 |
| 4,795,149 | 1/1989 | Pearson . | |
| 4,815,746 | 3/1989 | Ward, Jr. . | |
| 4,826,157 | 5/1989 | Fitzpatrick . | |
| 4,898,381 | 2/1990 | Gordon . | |
| 4,974,838 | 12/1990 | Sollenberger . | |
| 5,018,725 | 5/1991 | Cook . | |
| 5,102,122 | 4/1992 | Piane, Jr. et al. . | |
| 5,135,453 | 8/1992 | Sollenberger . | |
| 5,211,614 | 5/1993 | Henes | 482/102 |
| 5,328,428 | 7/1994 | Huang . | |
| 5,466,204 | 11/1995 | Nearing | 482/99 X |
| 5,542,895 | 8/1996 | Colbo, Jr. | 482/98 |

FOREIGN PATENT DOCUMENTS

| | | | |
|---|---|---|---|
| 2627090 | 8/1989 | France | 482/142 |
| 3300073 | 7/1984 | Germany | 482/98 |
| 1151656 | 5/1969 | United Kingdom | 482/103 |
| 86/06644 | 11/1986 | WIPO | 482/112 |

OTHER PUBLICATIONS

Trotter Fitness Line Brochure, 1994.
ROM "The Time Machine" Brochure, Undated.
Tuff Stuff High Performance Body Building Equipment Brochure, Undated.
CYBEX Personal Direct Drive 200 Brochure, Undated.
Soloflex "This Is The Way" Brochure, Undated.
Nordic Flex Gold "The Isokinetic Advantage" Brochure, 1994.
Trimax Brochure, 1992.
Pacific Fitness Monterey Brochure, 1995.
Pacific Fitness, Pacific 1000 Brochure, 1994.
Pacific Fitness, Pacific 2000 Brochure, 1994.
Pacific Fitness Del Mar Brochure, Jan. 1996.
Pacific Fitness Ventura Brochure, 1994.
Pacific Fitness Malibu Brochure, 1994.
Parabody Factor 525 Brochure, 1993.
Vectra C1 Brochure, 1995.

*Primary Examiner*—Richard J. Apley
*Assistant Examiner*—John Mulcahy
*Attorney, Agent, or Firm*—Banner & Witcoff Ltd.

[57] ABSTRACT

An exercise apparatus provides free weight-like exercises, without the inconvenience and dangers of free weights. The apparatus also provides increased exercise versatility and highly compact storage. An exemplary embodiment includes a barbell connected between pull-lines of independent weight stack units and otherwise free of supporting structure. The initial positions of the ends of the pull-lines are adjustable, allowing the exercise bar to be maintained in a vertically adjustable rest position. Each line is extensible against a bias of a corresponding weight stack, independently of the other line segment, to allow the bar to be moved in an exercise stroke upwardly from its rest position. Each line is independently retractable, by the bias, to allow a return stroke of the bar to its rest position. A mounting of the weight stack units on wall mounted or free-standing rails allows the weight stack units to be moved between various usage positions and a highly compact corner storage position. In the storage position, the units form, with the framework, a storage space that accommodates a collapsible user support bench, the barbell, and other accessories.

43 Claims, 9 Drawing Sheets

EXERCISE APPARATUS PROVIDING SIMULATED FREE WEIGHT EXERCISES AND COMPACT STOWAGE

BACKGROUND OF THE INVENTION

The present invention relates to multi-purpose exercise equipment, wherein a number of different exercises are performable with different components of an integrated structure. In particular, the invention concerns multi-purpose exercise machines employing resistance means other than free weights, e.g., confined weight stacks and/or non-gravity based exercise resistance elements. Unlike previous devices, the invention allows for the performance of free weight-like exercises and a high degree of stowability. The latter feature makes the machine particularly suitable for installation and use in space limited settings, e.g., homes and offices.

With the object of allowing convenient and safe strength training (i.e., muscle development) in multiple parts of the body, as well as aerobic conditioning, a myriad of exercise machines have been developed to replace the traditional bench, bar, and free weight combination. These machines provide multiple exercise stations and functionalities utilizing weight stacks and a variety of nongravity based exercise resistance components, e.g., fluid cylinders, elastic bands, centrifugal brakes and flexible bows. Machines such as these are often intended to facilitate circuit weight training (CWT).

CWT was developed in the mid-nineteen fifties to promote both aerobic and muscular fitness in athletes. CWT provides muscle development by requiring an athlete to work varying muscle groups to the point of local muscle fatigue. Aerobic conditioning is achieved by loading the cardiovascular system through maintenance of a constant moderate pace throughout and between exercises. A typical circuit consists of 8–10 exercises, each with 10–15 repetitions, performed three times and lasting a total of 30 minutes. Typically, a maximum of 30 seconds of rest between the exercises is allowed. In order to maintain such a pace, the exercise machine must have a high degree of user friendliness, i.e., the required set-up for each exercise must be simple and easy to allow smooth and rapid transitions between exercises.

Weight stacks and other gravity based resistance systems generally provide isotonic resistance, i.e., constant resistance throughout the exercise. This type of resistance is generally preferred by serious athletes for muscle development. Multi-purpose exercise machines employing weight stacks have been offered by numerous companies, including Vectra Fitness of Redmond, Wash.; Parabody, Inc. of Ramsey, Minn.; Trotter Co. of Medway, Mass.; Pacific Fitness Corp. of Cypress, Calif.; and the Cybex division of Lumex, Inc., Kirkland, Wash. Exemplary exercise machines utilizing weight stacks are disclosed in U.S. Pat. Nos. 5,328,428 (Huang); 4,826,157 (Fitzpatrick); 4,898,381 (Gordon); and 4,603,855 (Sebelle).

In their simplest form, weight stack resistance machines comprise a cable connected at one end with a desired number of weight plates (by selective placement of a pin or the like) and having a second end equipped with a connector for attachment of an exercise handle or bar. A pair of weight stacks (e.g., Huang '428), or a pair of independently movable handles attached to a single common weight stack (Fitzpatrick '157), may be provided adjacent each other to enable the performance of synchronized leg or arm exercises, e.g., cross-over exercises and the like.

Weight stack-type exercise machines have also been roller and wheel mounted for moveability. See U.S. Pat. Nos. 5,102,122 (Piane, Jr. et al); 2,632,645 (Barkschat); and 2,977,120 (Morris). Foldable/retractable benches have been used to reduce storage space. See Huang '428, Fitzpatrick '157, Sebelle '855 and Barkschat '645. A useful feature in a number of known weight stack based machines is means for varying the position of the guide pulleys which set the initial position of the exercise handle or bar. In this manner, different parts of the body, e.g., arms and legs, can be exercised, and users of different sizes can be accommodated. See, e.g., Piane, Jr. et al. '122, Morris '120, Sebelle '855 and Cook U.S. Pat. No. 5,018,725.

Elastic bands produce progressive resistance, i.e., resistance that increases/decreases as full extension/contraction is achieved. A widely known elastic band resistance exercise machine is the SOLOFLEX offered by Soloflex, Inc. of Hillsboro, Ore. Fluid cylinders and centrifugal brakes produce isokinetic resistance, i.e., resistance that increases with the force and speed of movement applied by the user. A fluid cylinder resistance machine has been offered by TRIMAX of Janesville, Wis. The Nordic Flex Gold by Nordic Track, Inc. of Chaska, Minn. is an example of a machine employing a centrifugal brake.

Generally speaking, exercise machines such as those described above can, as compared with free weights, provide added versatility and reduce the risk of injury (e.g., due to dropping or becoming pinned beneath the weights). Such machines can also make adjustment of exercising resistance easier and more convenient than with free weights and, with some arrangements, stowability is improved. However, these advantages are not without attendant disadvantages. In particular, as recognized in Sollenberger U.S. Pat. Nos. 5,135,453 and 4,947,838, such weight/exercise apparatus do not afford the freedom of exercising movement of free weights. As a result, a large number of separate stations or setups may be required in order to provide all of the desired exercise variations. Additionally, exercises such as bench presses are performed with a bar that pivots in a defined path (e.g., Gordon '381) or slides in a guideway (Huang '428). Such single plane motion eliminates or substantially reduces the work of mid-course corrective muscles required to maintain the bar in a balanced state. The result is inefficient and/or incomplete conditioning.

The Sollenberger patents disclose exercise apparatus intended to address the above-mentioned shortcomings of other multi-purpose weight/exercise machines. A weight stack resistance machine has a horizontal bar having movement characteristics intended to simulate a free barbell. Each end of the bar is connected by a pulley and cable arrangement to a respective weight stack. The bar moves up and down on a pair of pivotable uprights. The feel of free weights is intended to be approximated by the pivotal freedom of the uprights and universal joints slidably connecting the ends of the bar to the uprights. The Sollenberger machines are bulky and complex, requiring a pair of uprights, connecting beams and a plurality of pivot links. Moreover, the bar arrangement of Sollenberger allows only very limited tilting and horizontal rotation of the bar, and such tilting and rotation requires an extension of the bar length (due to the connection of the bar ends to the pivotal uprights) through utilization of telescoped bar segments. Despite its objects, it is apparent that such an apparatus could not provide a close approximation of a free barbell. Additionally, removal of the bar and supporting structure, e.g., to enable the performance of other exercises, would be difficult, and such a large assemblage could not be easily stowed away in a small space.

SUMMARY OF THE INVENTION

In view of the foregoing, it is a principal object of the present invention to provide an exercise apparatus which allows the performance of free-weight like exercises, but with improved safety and convenience as compared with free weights.

It is a further object of the present invention to provide a multi-purpose exercise apparatus suitable for use in circuit weight training (CWT), with easy adjustability to allow the performance of a myriad of different exercises and to adapt to different users.

It is another object of the present invention to provide a multi-purpose exercise apparatus which is conveniently stowable in a highly compact space, and thus suitable for use in space limited settings, e.g., homes and offices.

Still another object of the present invention is to provide a multi-purpose exercise apparatus that is simple in construction, durable in use, and relatively easy and inexpensive to manufacture and install.

These and other objects are achieved in accordance with the present invention by an exercise apparatus comprising an elongated exercise bar for grasping by a user; a framework supporting at least one source of adjustable exercise resistance; and a pair of flexible line segments operably connected with the at least one source of exercise resistance and having respective end portions attached to proximal end portions of said exercise bar, the exercise bar being otherwise free of supporting structure. The line segments are supported and attached to the at least one source of exercise resistance such that the exercise bar is maintained in a vertically adjustable rest position. Each of the line segments is extensible against a bias of the at least one source of exercise resistance, independently of the other line segment, to allow the bar to be moved upwardly away from its rest position. Each line segment is independently retractable, by the bias, to return the bar to its rest position.

In another aspect, the invention is embodied in an exercise apparatus comprising a pair of independent exercise resistance units. Each unit comprises a source of exercise resistance and a movable exercise member operably connected to the source of exercise resistance. A framework mounts the two exercise resistance units for horizontal movement, in intersecting planes, between (1) a storage position wherein the units are positioned adjacent each other proximal an apex of the intersecting planes so as to form, with the framework, a storage space therebetween; and (2) usage positions wherein the units are spaced from the apex for performance of exercises. A user support bench has a generally planar body support member and a supporting leg attached thereto. The supporting leg is collapsible against the body support member so as to allow the bench to be stored upright in the storage space.

These and other objects, features and advantages of the present invention will be readily apparent and fully understood from the following detailed description of the preferred embodiments, taken in connection with the appended drawings.

DETAILED DESCRIPTION OF THE PREFERRED EMBODIMENTS

Figure 1:
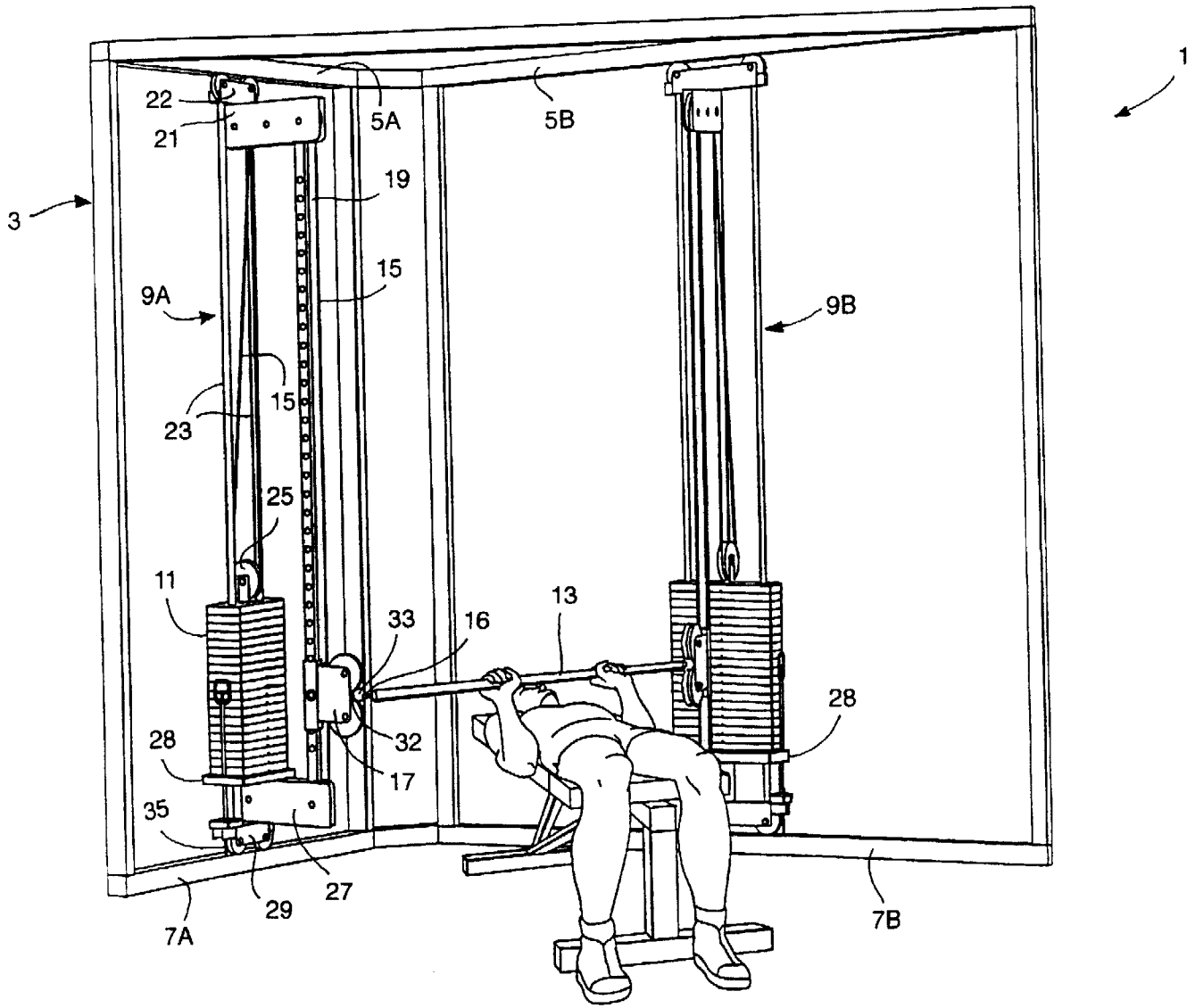
FIG. 1 is a perspective view showing a free standing exercise apparatus in accordance with the present invention, including movable weight stack units with adjustable pull-position pulley blocks; the apparatus is shown set up and being used to perform bench press exercises.
Figure 2:
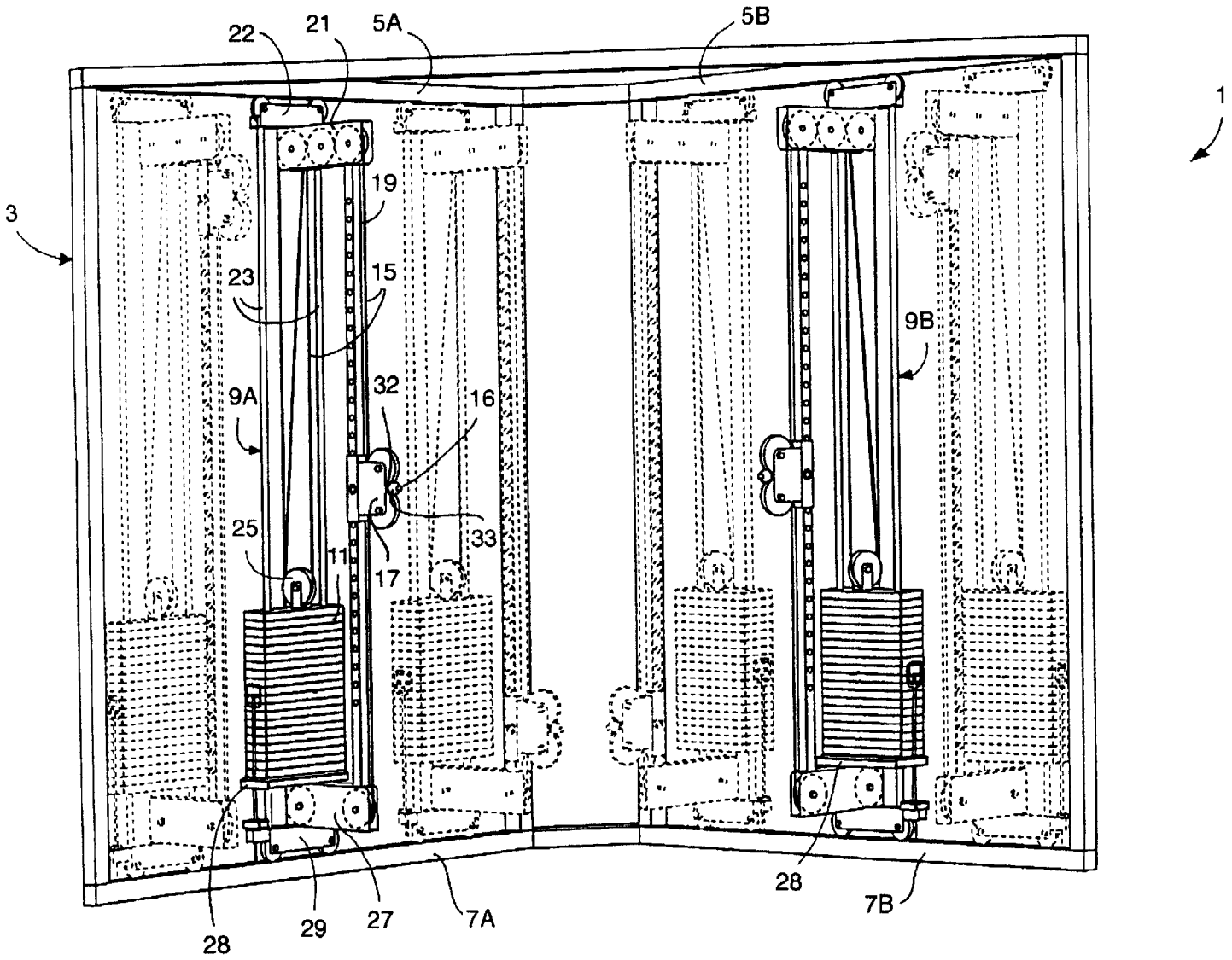
FIG. 2 is a perspective view of the apparatus of FIG. 1, with alternative use positions for the weight stack units and adjustment pulley blocks illustrated in phantom.

The exercise apparatus of the present invention can be free standing or wall mounted. FIGS. 1 and 2 illustrate a first preferred exercise machine embodiment 1 including a free standing generally L-shaped frame 3 comprising sets of upper rails 5A, 5B and lower rails 7A, 7B, mounting a pair of exercise resistance units 9A, 9B for movement toward and away from each other in intersecting planes, e.g., 90°, as shown. FIGS. 3, 4 and 6–8 show a second embodiment wherein upper and lower wall mounted rails 5A', 7A', 5B', 7B', similarly movably mount resistance units 9A, 9B. In the illustrated preferred embodiments, the exercise resistance units 9A, 9B are adjustable weight stack units providing independent sources of isotonic exercise resistance. Isotonic resistance is considered most desirable in order to provide free weight-like exercises, as will be described. It is envisioned, however, that other types of exercise resistance could be provided, including progressive and isokinetic resistance, utilizing various known mechanisms as described in the Background of the Invention section.

Since weight stack units 9A, 9B are essentially identical, forming mirror images of each other, a description of one will suffice. Weight stack unit 9A includes a stack of weight plates 11 operably connected through a block and tackle assembly with one end of a barbell 13. In particular, the block and tackle assembly comprises a flexible pull-line 15 (e.g., a cable) having an end portion equipped with a ring or other conventional connector member 16 releasably attachable to one end of barbell 13. A pull-position adjustment pulley block 17 is releasably attachable at different positions along a vertical guide beam 19, by a known aperture and locking pin arrangement, and serves to establish a vertically adjustable pull origination point, i.e. rest position for connector member 16. In order to maximize exercise versatility and freedom of movement, pulley block 17 is preferably mounted to pivot freely in the horizontal plane. With barbell 13 attached at its opposite ends to a connector member 16 of each weight stack unit 9A, 9B, the pull-position adjustment pulley blocks 17 serve to establish a vertically adjustable rest position of the barbell.

As shown, barbell 13 is usable to perform bench press and squat exercises. It is also usable to perform a myriad of other exercises, of the type performed with free weights, and others. Since the structure supporting the barbell is limited to pull-lines 15 with respective connectors 16, the degree of freedom of movement of barbell 13 approaches that of a free weight barbell. Barbell 13 can be tilted end-to-end, horizontally rotated, and rotated about its longitudinal axis. It can be moved forward, backward and side-m-side. In addition, the arrangement requires the user to maintain balance of the bar. Thus, mid-course corrective muscles are conditioned as they are with free weights. At the same time, safety and convenience are increased over free weights. Free weights do not have to be lifted and positioned in order to vary exercise resistance. Moreover, barbell 13 will not fall below its rest position as defined by the positions of adjustable pulley blocks 17. Thus, the risk of being pinned beneath the weights is substantially eliminated.

It should also be understood that the present inventive apparatus is not limited to exercises with a barbell. Rather, a variety of exercise attachments, e.g., handles and bars, as are known in the art, may be attached to connectors 16. This allows numerous different exercises to be performed with the two weight stack units, individually and together.

The structure of weight stack unit 9A is now further described in relation to the path of line 15, starting from the end opposite that equipped with connector member 16. The opposite end of line 15 is firmly anchored within the housing of adjustment pulley block 17. Line 15 extends from adjustment pulley block 17 upwardly along guide beam 19 to a fixed upper pulley block 21.

Figure 5:
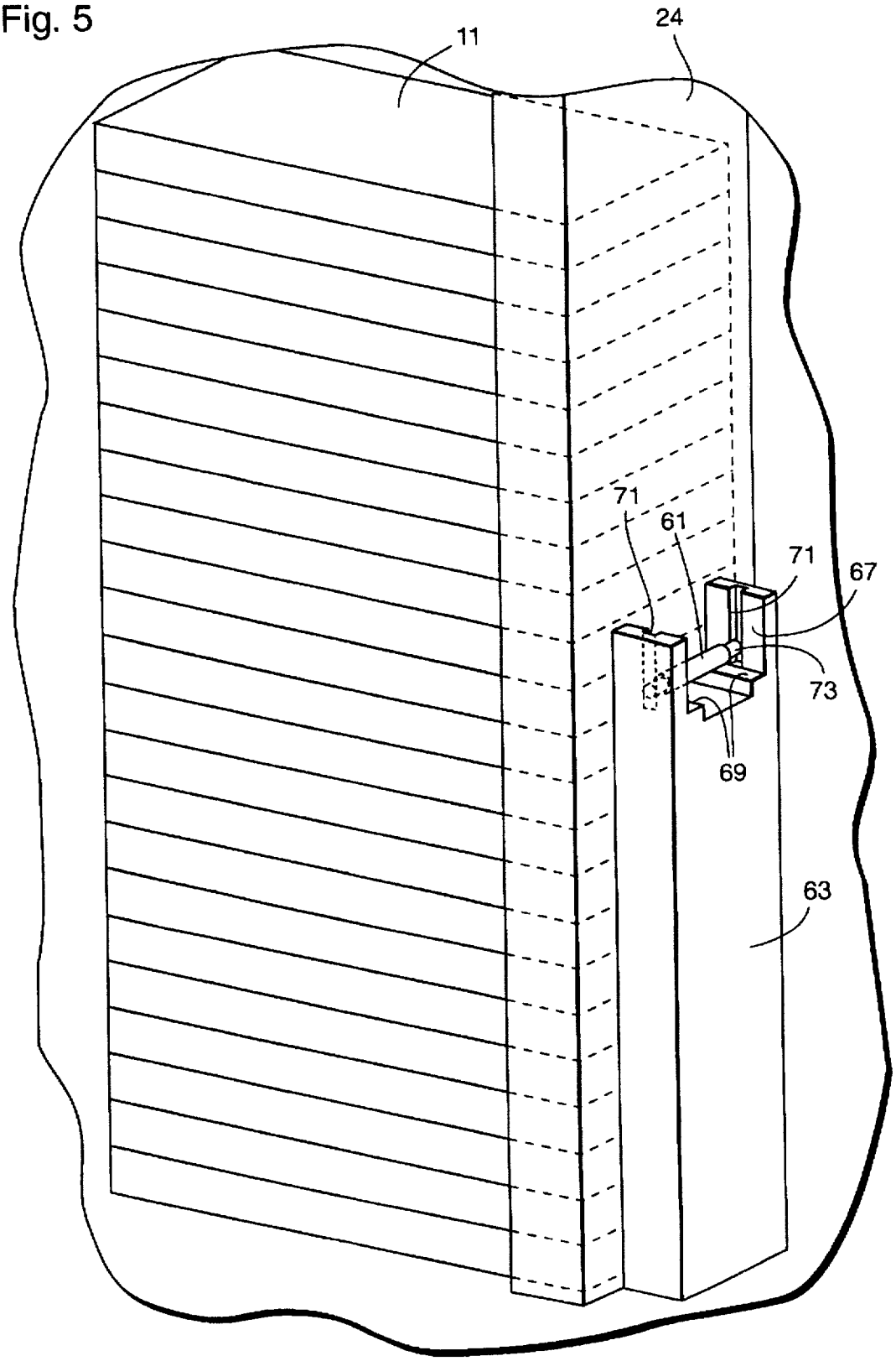
FIG. 5 is a partial perspective view of an alternative arrangement for guiding the vertical movement of the weight plates of the weight stack units.
Figure 6:
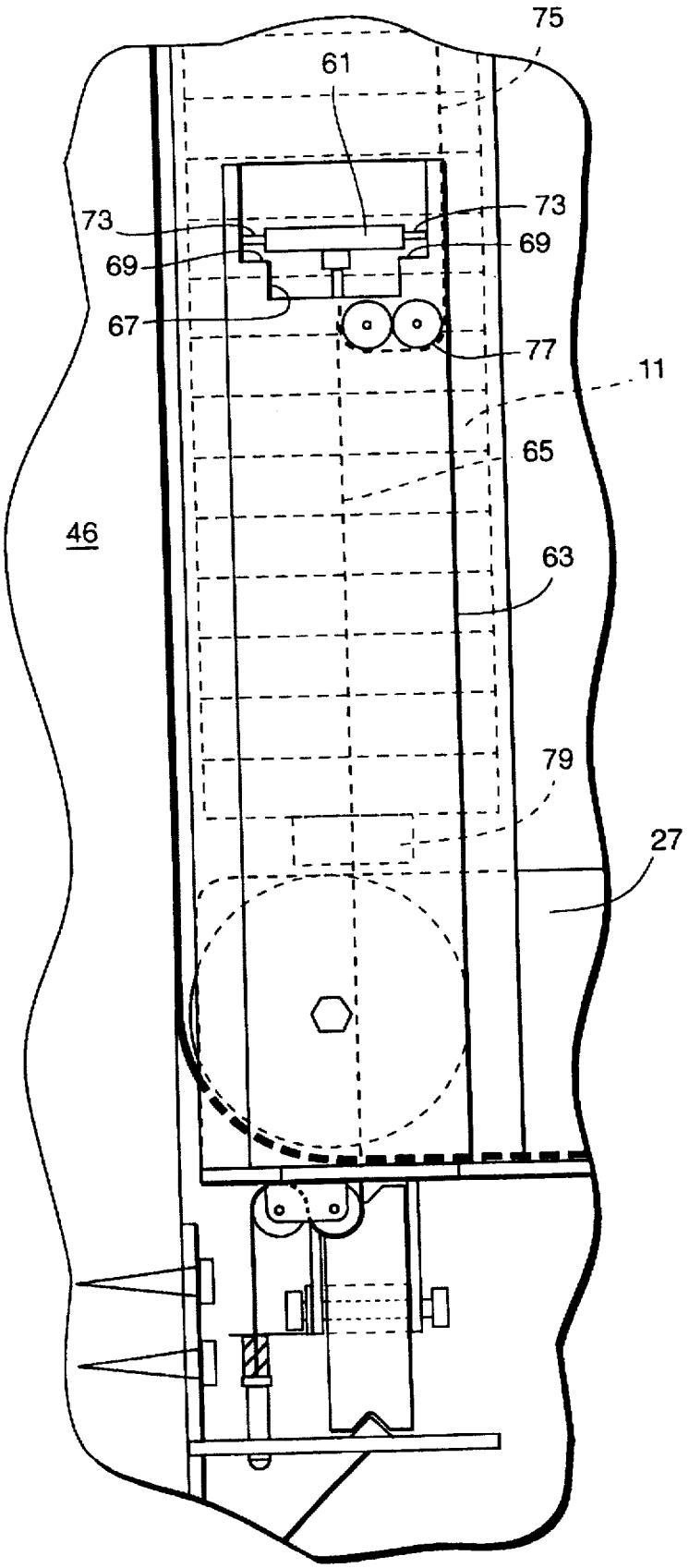
FIG. 6 is a partial side elevational view of the alternative arrangement illustrated in FIG. 4.

Upper pulley block 21 comprise three pulleys and a structural housing serving as an upper mounting location for guide beam 19. Pulley block 21 also serves as a mounting location for an upper roller housing 22. Housing 22 mounts a pair of rollers which are configured to ride along upper rail 5A. Housing 22 also serves as a structural member providing an upper mount for supporting a pair of vertical guide rods 23 extending through aligned apertures in stacked weight plates 11. Instead of vertical guide rods, other guide member arrangements could be used. For example, as shown in FIGS. 5 and 6, a pair of shallow U-shaped guide members 24 (only one shown) running along opposite sides of the weight stack can serve to guide the vertical movement of the weight plates 11. In this case, guide member 24 would be suitably secured to housing 22.

Line 15 passes over an outermost and middle of the three pulleys of upper pulley block 22 and extends downwardly to a movable (½ load reduction) pulley block 25. Movable pulley block 25 is mounted to the top of a weight plate attachment rod (not visible) which is passable through and selectively engageable with the weight plates in stack 11, by known means such as aligned spaced apertures in the rod and plates, and a removable interlock pin. Preferably, movable pulley block 25 is welded or otherwise attached to the top weight plate in order to maintain line 15 in a taut condition.

From the movable pulley block 25, line 15 extends upwardly to wrap around an innermost pulley of upper pulley block 21. Line 15 then extends downwardly to a fixed lower pulley block 27.

Similar to upper pulley block 21, the housing of lower pulley block 27 serves to provide a lower mounting location for guide beam 19, and a lower roller housing 29. Lower roller housing 29 is configured like upper roller housing 22 to mount a pair of rollers which ride along lower rail 7A (7A'). Housing 29 also serves, like upper housing 22, as a structural member providing a lower mount for supporting vertical guide rods 23 (In the case of the FIGS. 4–5 embodiment, U-shaped guide members 24 would be mounted at their lower ends to housing 29.)

Lower pulley block 27 can be provided with a reinforced housing or frame in order to serve as a stop for stacked weight plates 11. Alternatively, separate or additional structure could be provided to perform this function. In particular, as illustrated, a stop block 28 can be secured between vertical guide rods 23 above pulley block 27. Although not illustrated, it would also be desirable to provide a spring bed or the like for absorbing the impact of dropped weight plates.

Preferably, the vertical guide members (e.g., rods 23 or U-shaped members 24) also serve as structural members for sharing the load of the lifted weight plates with vertical guide beam 19. In this manner, in contrast with conventional weight stack arrangements, the need for additional weight bearing structural framing is avoided. As a result, the weight stack units of the present invention are more compact, requiring less space for both use and storage. To achieve optimum balance, guide rods 23 (or U-shaped members 24) are preferably located directly above the rollers.

Line 15 wraps around inner and outer pulleys of lower pulley block 27 then returns upwardly to adjustment pulley block 17. Adjustment pulley block 17 comprises a pair of pulleys mounted one directly above the other to form a nip 32 through which line 15 passes. Directly behind connector 16 is a stopper 33, shown in the form of a bail, to maintain connector member 16 in a readily accessible rest position (prevented from slipping through nip 32).

As described above, line 15 passes through upper pulley block 21, movable pulley block 25, lower pulley block 27 and adjustment pulley block 17 to form an open loop. When adjustment pulley block 17 is moved to different positions along guide beam 19, the loop moves in a free orbit, thereby allowing adjustment of the pull-position without any line take-up device.

Weight stack units 9A, 9B can move independently of one another on their respective pairs of upper and lower rails 5A, 7A, 5B, 7B (5A', 7A', 5B', 7B' as shown in FIGS. 3, 4 and 6–8). A locking arrangement is provided for allowing each weight stack unit to be conveniently releasably held, i.e., locked, in a desired position along the rails. The locking arrangement may comprise a series of spaced apertures in one or both of the upper and lower rail assemblies, and a locking mechanism on each weight stack unit comprising upper and/or lower pins that are selectively extensible into and retractable from the rail apertures. The capability to selectively lock each weight stack unit in different horizontal positions, coupled with the vertical adjustability afforded by adjustment pulley block 17, allows the pull-position, i.e., rest position of connector 16, of each weight stack unit to be moved substantially throughout a range of x-y coordinates within the boundaries of the respective upper and lower rails. Exemplary positions of the weight stack units 9A, 9B and corresponding adjustment pulley blocks 17 are illustrated FIG. 2. This mobility provides a very high degree of versatility, allowing a wide range of different exercises and exercise variations to be performed (with one weight stack unit or both simultaneously).

In the free standing embodiment of FIGS. 1 and 2, a locking mechanism is illustrated with a lower pin 35 for engaging apertures in lower rail 7A. In the wail mounted rail embodiments shown in FIGS. 3, 4 and 6, a modified locking mechanism has a lower pin 35 for engaging apertures in lower rail 7A', as well as an upper pin 37 for engaging apertures in upper rail 5A'. A two pin arrangement is generally preferred to provide additional stability and increased locking strength.

The following description of the locking mechanism on the weight stack units is generally applicable to both the wall mounted and free standing embodiments. It will be understood that both embodiments may comprise either one or both of upper and lower locking pins.

Figure 4:
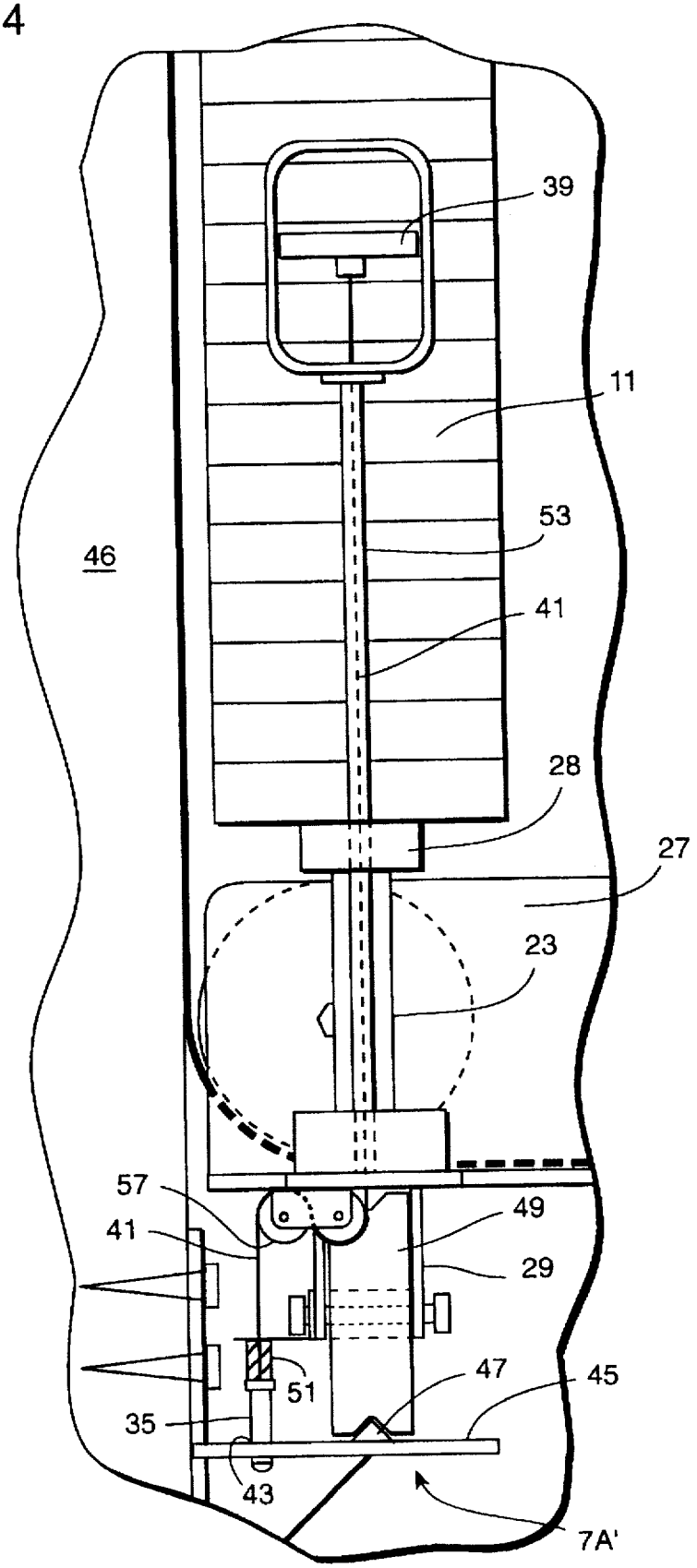
FIG. 4 is a close-up partial side elevation view showing structure of a weight stack unit braking mechanism in accordance with the present invention.

As seen most clearly in FIG. 4, lower pin 35 is operably connected with a hand graspable handle 39 by a flexible line, e.g., a cable 41. Handle 39 serves to actuate movement of pin 35 into and out of a selected aperture 43 provided in lower rail 7A'. In the particular rail assembly shown, the apertures extend through a braced horizontal bracket 45 which is suitably anchored to a wall 46. Bracket 45 supports an elongated engagement element 47 of triangu along which a pair of complimentary shaped rollers 49 (only one visible in FIG. 4) ride. Obviously, the apertures could extend directly along the engagement element (as generally depicted in FIGS. 1 and 2) or along some other adjacent supporting structure. (References herein to the upper and lower rails refer generally to the engagement element itself as well as any adjacent supporting structure.)

In the illustrated embodiment, pin 35 is biased to an extended position by a compression spring 51. In this manner, pin 35 will remain engaged until it is retracted (released) by an upward pull on handle 39. Handle 39 is conveniently positioned alongside stacked weight plates 11. It is supported on a vertically extending tubular housing 53 providing a conduit for cable 41. Housing 53 may be suitably rigidly mounted through a base assembly or piece 55 on an upper side of lower roller housing 29. Housing 53 also extends through and is braced by stop block 28. This arrangement enables handle 47 to also be used as a gripping member capable of being pushed or pulled to move the weight stack unit along the rails. Thus, with the illustrated handle arrangement, movement of weight stack 9A, 9B can be effected immediately after pin retraction, and without any change in hand position. On a lower side of the roller housing 29 is a pair of cable guide pulleys 57 serving to suitably displace cable 41 to the offset position of the apertures.

It will be understood that other known locking arrangements could be used, including foot actuated mechanisms of the type commonly associated with sliding doors. In such devices, a locking pin is releasably held in an extended position and spring biased to a retracted rather than extended position. If a foot actuated brake or lock is used it would be desirable to provide another structure suitable as a gripping member for moving the weight stack unit along the rails.

Figure 3:
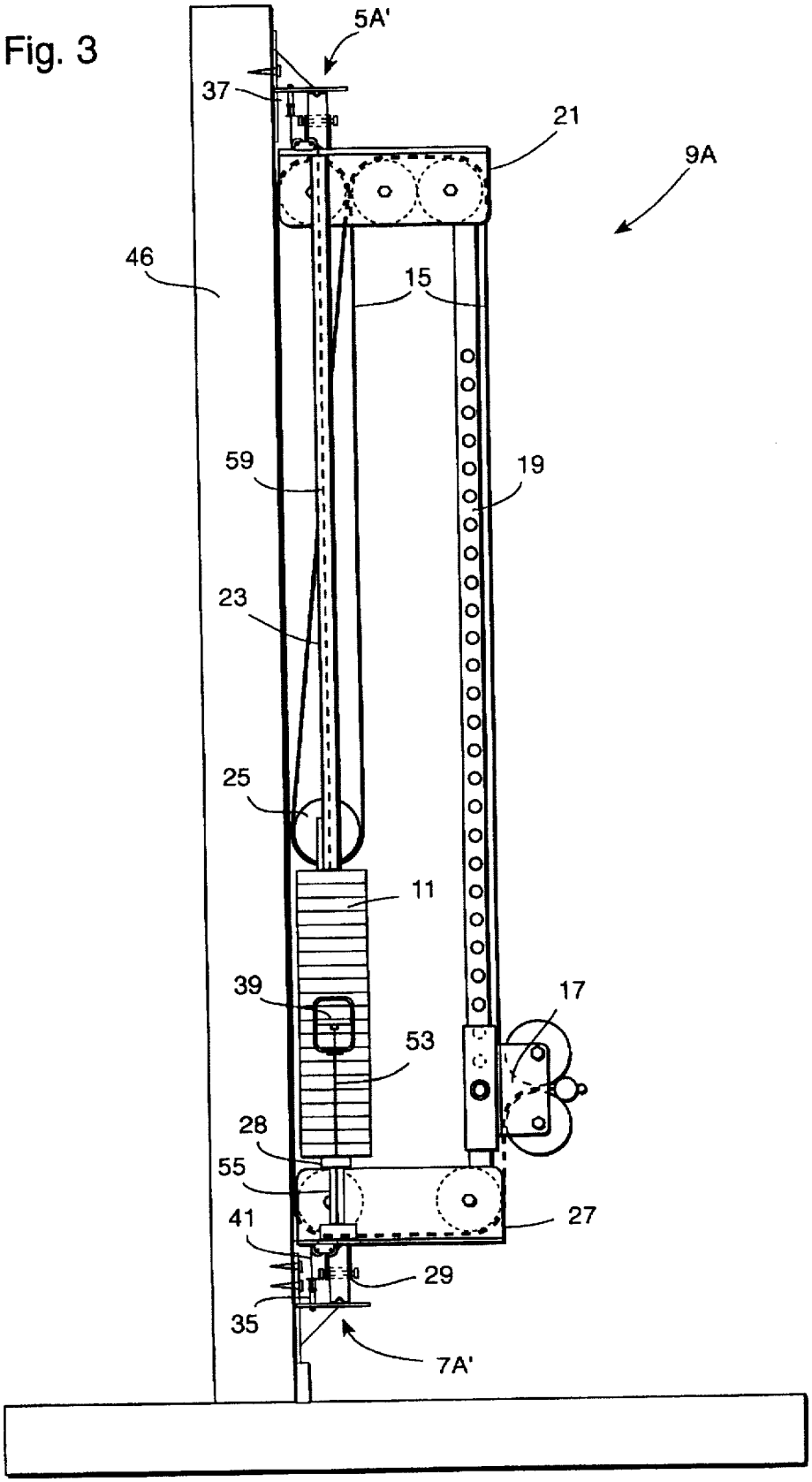
FIG. 3 is a side elevational view of a weight stack unit of a wall mounted exercise apparatus in accordance with the present invention.

In FIG. 3 it can be seen that upper pin 37 is similarly operably connected with handle 47 by a cable 59, and is spring biased to selectively engage apertures provided along upper rail 5A'. Upper rail 5A' is basically a mirror image of lower rail 7A'. However, it should be evident that, being positioned above weight stack unit 9A, upper rail 5A' serves only as a guide and to maintain the unit upright. It does not serve to support any substantial part of the load of the weight stack unit. Therefore, its mounting to wall 46 need not have the substantial reinforcement required for lower rail 7A' (which does support the weight of weight stack unit 9A).

In the illustrated embodiment, one of the two vertical guide rods 23 is provided with a lengthwise passageway serving as a conduit for cable 59 between upper pin 37 and the region of lower pulley block 27 and roller housing 29. From there, a suitable guide pulley arrangement (not visible) will direct the cable into a bottom or side opening of tubular housing 53. From there, cable 59 can extend parallel to cable 41 through tubular housing 53 and up to handle 39 (this segment of cable 59 not shown).

In the alternative arrangement of FIGS. 5 and 6, the locking mechanism on the weight stack units is configured somewhat differently. In this case, a lock handle 61 is supported within an elongated housing 63 secured directly to the side of one of the U-shaped weight plate guide members 24. As shown, housing 63 provides a conduit for cable 65 attached to handle 61. Access to handle is provided by a cut-away region 67 of housing 63. The handle is mounted to rest on a shelf 69, and slots 71 along sidewalls of the housing cooperate with tabs or extensions 73 on the ends of handle 61 for guiding the handle up and down.

As seen in FIG. 6, a second cable 75 extends from the handle, through a set of guide pulleys 77, and upwardly to an upper pin (not shown). Second cable 75 may extend to the upper pin within an internal longitudinal groove provided in the U-shaped guide member, or in some other manner such as outside the guide member within a flexible sheathing, e.g., of the type commonly used for bicycle control cables. A block 79 extends between the guide members above lower pulley block 27. Block 79 serves to support the dead weight of the weight stack and to absorb the impact of dropped plates, similar to block 28. It may be provided with a spring bed or other type of impact absorbing member (not shown).

Figure 7:
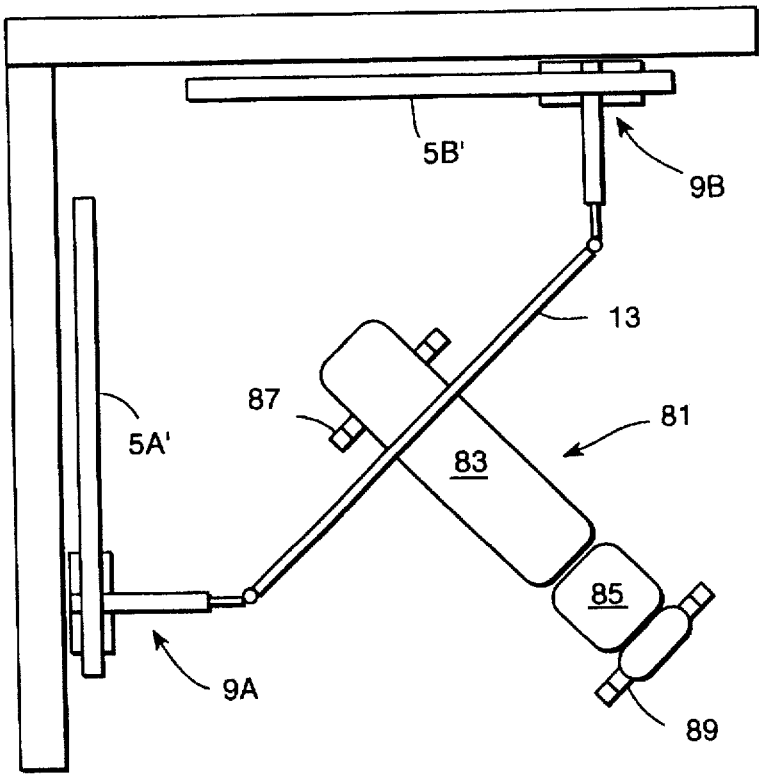
FIG. 7 is a diagrammatic top plan view of a wall mounted exercise apparatus in accordance with the present invention, set up for the performance of bench press exercises.
Figure 8:
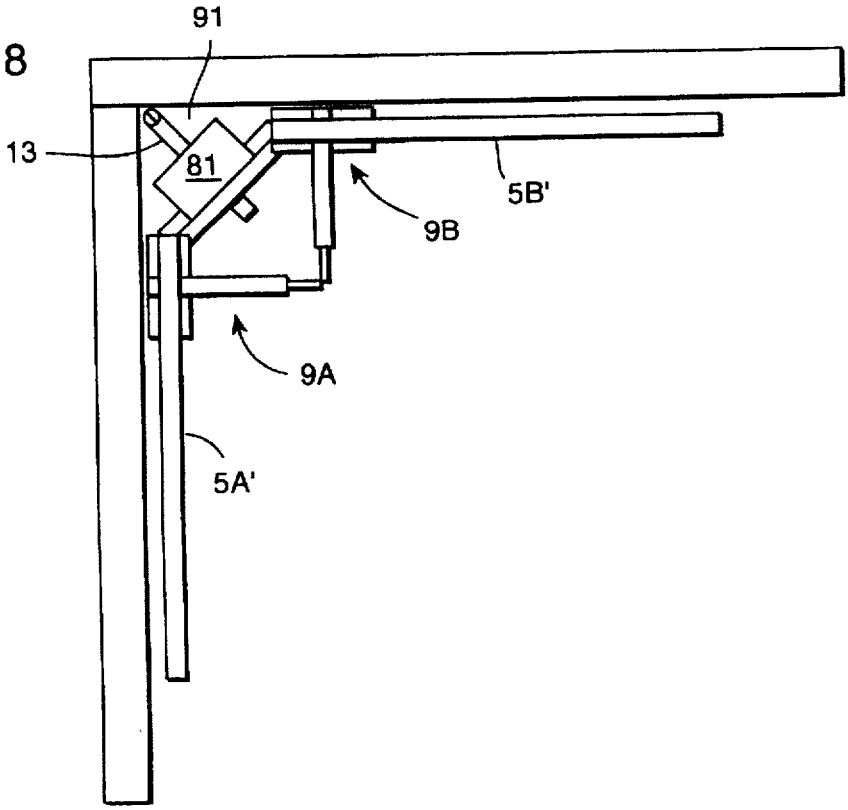
FIG. 8 is a diagrammatic top plan view of the apparatus of FIG. 4 in a stowage position.

Referring now particularly to FIGS. 7 and 8, it is seen how the wall mounted embodiment of the present invention can be installed in a comer area of a room, for highly space efficient use and storage. The set-up illustrated in FIG. 7 is for the performance of bench press exercises. Weight stack units 9A, 9B are spaced from the apex of the intersecting planes of their movement (i.e., the room comer). Barbell 13 is connected at its ends to respective pull-lines of weight stack units 9A, 9B, and a user support bench 81 is positioned therebelow. Bench 81 comprises a pair of articulated generally planar body support members 83, 85, and a pair of supporting legs 87, 89 attached thereto. Body support member 83 is preferably movable to different inclined positions in order to allow for performance of inclined bench presses and other exercises.

In FIG. 8, barbell 13 has been disconnected from weight stack units 9A, 9B, bench 81 has been collapsed, and weight stack units 9A, 9B have been moved along the rails to positions adjacent each other and proximal the room comer. So positioned, a space 91 between the weight stack units and supporting framework (in this case, the walls) is created, and that space is utilized to store, upright, collapsed bench 81 and barbell 13. In addition, other exercise accessories, including other attachments to connectors 16, may be stored in space 91.

Figure 9A:
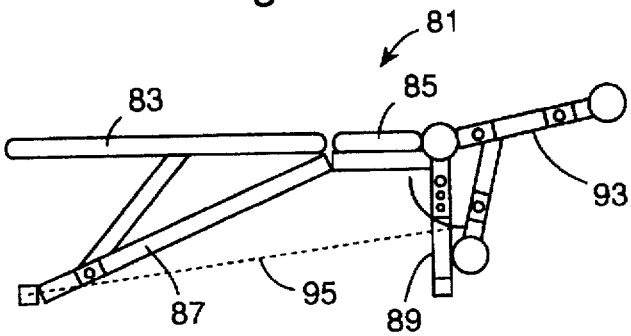
FIGS. 9A–9D are side elevation views a body support bench in accordance with the present invention, sequentially illustrating the collapsibility of the bench for storage.
Figure 9B:
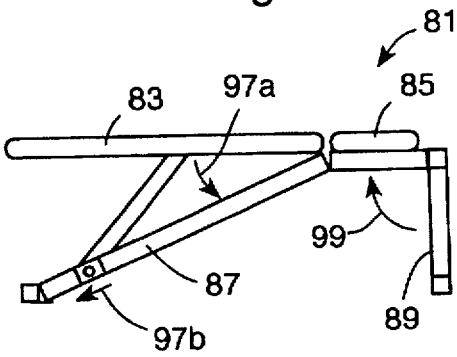
Figure 9C:
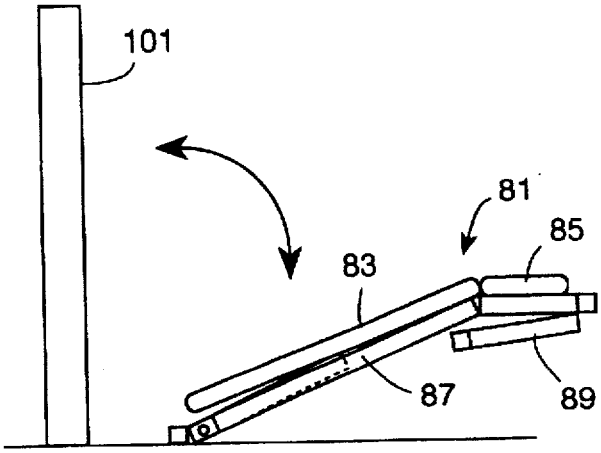
Figure 9D:
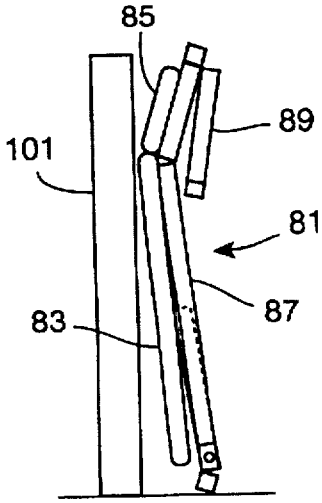

The folding or collapsing of bench 81 is sequentially illustrated in FIGS. 9A–9D. FIG. 9A also shows a leg extension attachment 93 to the bench that can be utilized in conjunction with weight stack units 9A, 9B. As schematically illustrated, a lever of leg extension attachment 93 can be operatively connected with one of weigh stack units 9A, 9B by a line 95 having a connector suitable for attachment to connectors 16. A second adjacent independent lever (not illustrated) could be similarly operably connected with the other weight stack unit in order to provide independent simultaneous exercise movement for both legs. In FIG. 9B, the leg extension attachment has been removed. Arrows 97*a*, 97*b* and 99 depict how body support member 83 pivots downwardly against inclined leg 87, and how leg 89 pivots upwardly against body support member 85, in order to collapse bench 81. FIGS. 9C illustrates the collapsed bench being pivoted to an upright position against a wall 101, and FIG. 9D illustrates bench 81 in its final upright storage position.

Figure 10:
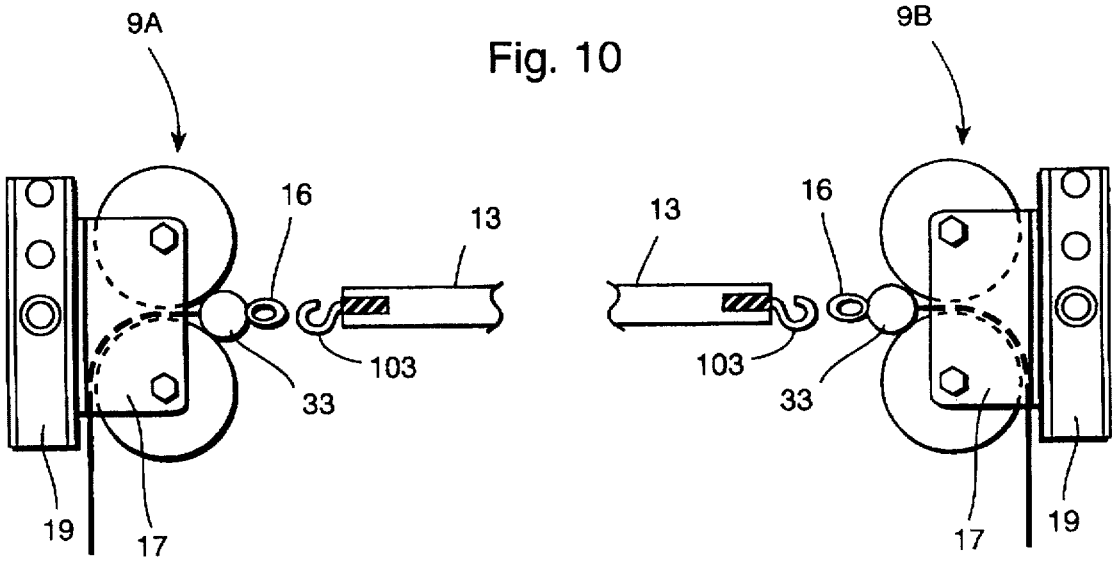
FIG. 10 is a diagrammatic side elevation assembly view illustrating a connection of a barbell with independent pull-lines in accordance with the present invention.

FIGS. 10–14 illustrate exemplary arrangements for attachment of barbell 13 to connectors 16 of weight stack units 9A, 9B. In FIG. 10, each end of barbell 13 is equipped with an open hook 103. An open hook has the advantage of allowing the user to remotely attach the ends of the barbell to connectors 16 by hand manipulation of the bar. This allows the user to position himself on the bench before the barbell is connected, whereby it is unnecessary to "squeeze" beneath the bar into position on the bench.

Figure 11:
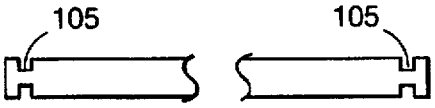
FIGS. 11–14 are side elevational views illustrating alternative barbell connector members.
Figure 12:
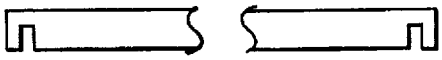

FIGS. 11 and 12 illustrate similar variations allowing remote engagement/disengagement of the bar ends to connector rings 16. In FIG. 11, an annular recess 105 is provided proximal each bar end, sized to receive therein a respective ring 16. In FIG. 12, a recess 107 is provided on only one side of the barbell for the same purpose. The FIG. 11 arrangement is generally preferable since it does not require any rotation of the barbell about its longitudinal axis in order to effect a proper engagement.

Figure 13:
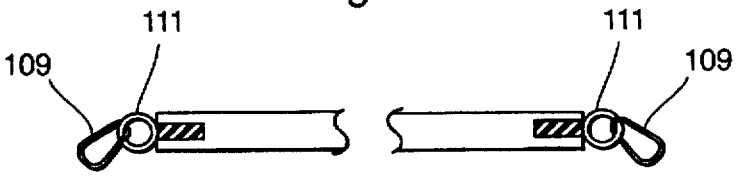
Figure 14:
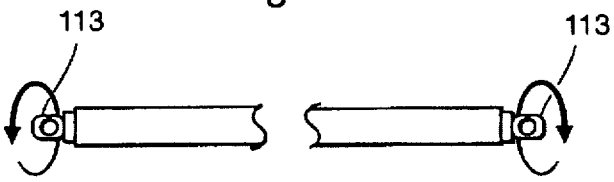

Certain exercises and circuit weight training routines may require the additional security of a conventional (fully closeable) spring clasp 109, as shown in FIG. 13. For attachment to clasps 109, the barbell ends can be equipped with fixed eyelets 111 (FIG. 13), or rotatable eyelets 113 (FIG. 14). A spring clasp could be provided on one end, with the other end being provided with a hook 103 as seen in FIG. 10. This would afford a greater degree of attachment security than two open hooks, yet would still allow the user to preposition himself on the bench prior to attachment of the barbell between the weight stack units.

Another possible arrangement would be to provide a threaded cup as connector 16 for engagement with a threaded end of barbell 13. The opposite end of barbell 13 could be provided with a rotatable eyelet 113 and clasp 109. This would allow a user to preposition himself on the bench, with the clasp end of the barbell connected to the line of one of the weight stack units, and then screw the threaded end of the barbell into the threaded cup connector of the other weight stack unit.

The present invention has been described in terms of preferred and exemplary embodiments thereof. Other embodiments, features and variations within the scope and spirit of the invention as defined in the appended claims will occur to persons of ordinary skill in the art from a review of this disclosure.

I claim:

1. An exercise apparatus comprising:

a framework supporting two adjustable exercise resistance units and mounting the two exercise resistance units for horizontal movement toward and away from each other in intersecting planes, each unit comprising a flexible line segment operably connected to a source of exercise resistance and having a respective end portion equipped with a connector adapted to be attached to a movable exercise member, said framework mounting such that they said resistance units movable to respective positions wherein the units are operable by a user in conjunction with each other to perform exercises;

said exercise resistance units supporting such that said respective end portions are maintained in respective vertically adjustable rest positions, each said line segment being extensible against a bias of a respective one of said sources of exercise resistance, independently of the other line segment, to allow the respective end portion to move away from its rest position, each said line segment being independently retractable, by said bias, to return the end portion to its rest position.

2. An exercise apparatus according to claim 1, wherein the two exercise resistance units provide isotonic exercise resistance.

3. An exercise apparatus according to claim 2, wherein said exercise resistance units comprise respective adjustable weight stack units.

4. An exercise apparatus according to claim 1, wherein the exercise resistance units each comprise a roller movably mounting the unit on a rail of said framework.

5. An exercise apparatus according to claim 4, said framework comprising upper and lower parallel rails, the exercise resistance units having upper and lower rollers for riding along said parallel rails.

6. An exercise apparatus according to claim 5, wherein each exercise resistance unit includes a releasable locking mechanism for selectively maintaining the exercise unit in a chosen position along the parallel rails.

7. An exercise apparatus according to claim 5, wherein said parallel rails are anchored to a wall.

8. An exercise apparatus according to claim 5, wherein said framework is free-standing.

9. An exercise apparatus according to claim 5, wherein the exercise resistance units each comprise an adjustable weight stack unit.

10. An exercise apparatus according to claim 9, wherein the center of gravity of the weight stack units is substantially aligned with said lower rail and the lower rail serves as a structural member bearing a major portion of the weight of each weight stack.

11. An exercise apparatus according to claim 9, wherein said lines are provided as parts of a respective block and tackle assembly of each adjustable weight stack unit, each weight stack unit further comprising a vertically extending guide member, a plurality of weight plates slidably mounted on said guide member, and a weight attachment member attached at its upper end to said block and tackle assembly, and being selectively engageable with said weight plates, for selectively lifting a desired number of the weight plates along the guide member.

12. An exercise apparatus according to claim 11, wherein said guide member serves as a structural member supporting a substantial portion of the load of the weight plates lifted therealong.

13. An exercise apparatus according to claim 11, wherein each weight stack unit further includes a releasable locking mechanism for selectively maintaining the weight stack unit in a chosen position along the parallel rails, the locking mechanism comprising a pin advanceable into and retractable from apertures provided in one of the parallel rails, and a lock handle connected therewith for actuating movement of the pin.

14. An exercise apparatus according to claim 13, wherein the lock handle is connected with said pin by a flexible line and supported adjacent a lateral side of the stacked weight plates by a vertically extending housing providing a conduit for passage of the line between the handle and the pin.

15. An exercise apparatus according to claim 13, wherein the lock handle is connected with said pin by a flexible line, and the vertically extending guide member has a longitudinally extending passageway providing a conduit for passage of the line between the handle and the pin.

16. An exercise apparatus according to claim 11, wherein each of the adjustable weight stack units further comprises a vertical guide beam and said block and tackle assembly includes a pull-position adjustment pulley block releasably adapted to be attached at different positions therealong, the adjustment pulley block serving to support respective ones of the line segment terminal end portions to thereby establish said adjustable rest position of the exercise bar.

17. An exercise apparatus according to claim 16, wherein said pull-position adjustment pulley blocks are mounted to pivot freely in a horizontal plane.

18. An exercise apparatus according to claim 16, wherein said block and tackle assembly further includes an upper pulley block comprising a plurality of fixed pulleys, a lower pulley block comprising two fixed pulleys, and a movable pulley block attached to the upper end of the weight attachment member, between said upper and lower pulley blocks, each said line having an end, opposite said end portion, attached to said adjustment pulley block to form an open loop passing through said upper, lower, movable and adjustment pulley blocks.

19. An exercise apparatus according to claim 4, wherein said framework comprises a pair of rails mounting the two exercise resistance units for movement in intersecting planes.

20. An exercise apparatus according to claim 1, wherein said planes are perpendicular to each other.

21. An exercise apparatus according to claim 1, wherein said framework mounts the two exercise resistance units for horizontal movement, in intersecting between (1) a storage position wherein the units are positioned adjacent each other proximal an apex of the intersecting planes so as to form, with said framework, a storage space therebetween; and (2) usage positions wherein the units are spaced from said apex for performance of exercises;

said exercise bar being a barbell adapted for releasable attachment to said connectors and upright in said storage space;

said apparatus further comprising a user support bench having a generally planar body support member and a supporting leg attached thereto, the supporting leg being adapted to collapse against the body support member so as to allow the bench to be stored upright storage in said storage space together with the exercise bar.

22. An exercise apparatus according to claim 21, wherein said support bench is a free-standing bench.

23. An exercise apparatus according to claim 1, further comprising an elongated exercise bar for grasping by a user, said respective end portions being adapted for attachment to said bar, proximate the ends thereof.

24. An exercise apparatus according to claim 23, wherein the exercise bar is a barbell which is adapted to be releasably attached to said line segment end portions, the line segment end portion and end portion of the bar on at least one side being configured to allow remote engagement/disengagement by hand-manipulation of the bar.

25. An exercise apparatus according to claim 23, wherein the bar comprises, proximal at least one of its ends, a hook for engaging a ring on the corresponding line segment end portion.

26. An exercise apparatus comprising:

a pair of independent exercise resistance units, each comprising a source of exercise resistance and a movable exercise member operably connected to said source of exercise resistance;

a framework mounting the two exercise resistance units for linear horizontal movement, between (1) a storage position wherein the units are positioned adjacent each other so as to form, with said framework, a storage space therebetween; and (2) usage positions wherein the units are spaced further apart from each other and operable by a user in conjunction with each other to perform exercises and a user support bench having a generally planar body support member and a supporting leg attached thereto, the supporting leg being adapted to collapse against the body support member so as to allow the bench to be stored upright in said storage space;

wherein, said framework comprises upper and lower rail segments on which upper and lower ends, respectively, of said two exercise resistance units are movably mounted; and wherein a major portion of said storage space is situated above said lower rail segments and below said upper rail segments.

27. An exercise apparatus according to claim 26, wherein the exercise resistance units each comprise a roller movably mounting the unit on a said rail segment of said framework.

28. An exercise apparatus according to claim 26, said rail segments comprising upper and lower parallel rails, the exercise resistance units having upper and lower rollers for riding along said parallel rails.

29. An exercise apparatus according to claim 28, wherein each exercise resistance unit includes a releasable locking mechanism for selectively maintaining the exercise unit in a chosen position along the parallel rails.

30. An exercise apparatus according to claim 28, wherein said parallel rails are anchored to a wall.

31. An exercise apparatus according to claim 28, wherein said framework is free-standing.

32. An exercise apparatus according to claim 26, wherein said framework mounts the two exercise resistance units for horizontal movement in intersecting planes, in said storage position the units are positioned adjacent each other proximal an apex of the intersecting planes, and in said usage positions the units are spaced from said apex.

33. An exercise apparatus according to claim 32, wherein said planes are perpendicular to each other.

34. An exercise apparatus according to claim 26, wherein the two exercise resistance units provide isotonic exercise resistance.

35. An exercise apparatus according to claim 34, wherein said exercise resistance units comprise respective adjustable weight stack units.

36. An exercise apparatus according to claim 35, wherein each said adjustable weight stack unit comprises a stack of weight plates and a block and tackle assembly, said assembly including a flexible line operably connectable with a selected number of said weight plates and having an end portion with a connector member for attachment to an exercise bar or handle;

each said weight stack unit supporting said line being such that said end portion is maintained in a vertically adjustable rest position, said line being extensible against a bias of said weight plates to allow the end portion to be moved upwardly away from its rest position, said line being retractable, by said bias, to return the end portion to its rest position;

each weight stack unit further comprising a vertically extending guide member, a plurality of weight plates slidably mounted on said guide member, a weight attachment member attached at its upper end to said block and tackle assembly, and being adapted for selective engagement with said weight plates, for selectively lifting a desired number of the weight plates along the guide member.

37. An exercise apparatus according to claim 36, wherein each weight stack unit further includes a releasable locking mechanism for selectively maintaining the weight stack unit in a chosen position along the rail segments, the locking mechanism comprising a pin advanceable into and retractable from apertures provided in one of the rail segments, and a lock handle connected therewith for actuating movement of the pin.

38. An exercise apparatus according to claim 37, wherein the lock handle is connected with said pin by a flexible line and supported adjacent a lateral side of the stacked weight plates by a vertically extending housing providing a conduit for passage of the line between the handle and the pin.

39. An exercise apparatus according to claim 37, wherein the lock handle is connected with said pin by a flexible line and the vertically extending guide member has a longitudinally extending passageway providing a conduit for passage of the line between the handle and the pin.

40. An exercise apparatus according to claim 36, wherein each of the adjustable weight stack units further comprises a vertical guide beam and said block and tackle assembly includes a pull-position adjustment pulley block releasably adapted to be attached at different positions therealong, the adjustment pulley block serving to support respective ones of the line end portions to thereby establish said adjustable rest position.

41. An exercise apparatus according to claim 40, wherein said adjustment pulley blocks are mounted to pivot freely in a horizontal plane.

42. An exercise apparatus according to claim 40, wherein said block and tackle assembly further includes an upper pulley block comprising a plurality of fixed pulleys, a lower pulley block comprising two fixed pulleys, and a movable pulley block attached to the upper end of the weight attachment member, between said upper and lower pulley blocks, said line having an end opposite said end portion attached to said adjustment pulley block to form an open loop passing through said upper, lower, movable and adjustment pulley blocks.

43. An exercise apparatus according to claim 26, wherein said support bench is a free-standing bench.

* * * * *

UNITED STATES PATENT AND TRADEMARK OFFICE

CERTIFICATE OF CORRECTION

PATENT NO. : 5,725,459

DATED : March 10, 1998

INVENTOR(S) : Marco L. Rexach

It is certified that error appears in the above-identified patent and that said Letters Patent is hereby corrected as shown below:

On the cover page, in the Abstract, line 15, change "wail" to --wall--.

Column 5, line 7, change "side-m-side" to --side-to-side--.

Column 6, line 28, change "bail" to --ball--,
line 63, change, "wail" to --wall--.

Column 7, line 16, delete "triangu" and insert --triangular cross-section--.

Column 8, line 30, change "comer" to --corner--,
line 34, change "comer" to --corner--,
line 46, change "comer" to --corner--.

Column 9, line 3, change "wail" to --wall--,
line 60, change "such that they said resistance units" to --said resistance units such that they are--,
line 64, after "supporting" insert --said line segments--.

Column 11, line 30, after "intersecting" insert --planes,--,
line 37, after "upright" insert --storage--.
line 44, delete "storage" (first Occurrence).

Signed and Sealed this

Twenty-first Day of July, 1998

Bruce Lehman

*Attest:*

BRUCE LEHMAN

*Attesting Officer*

*Commissioner of Patents and Trademarks*